US005803152A

United States Patent [19]

Dolman et al.

[11] Patent Number: 5,803,152

[45] Date of Patent: Sep. 8, 1998

[54] MICROSTRUCTURALLY REFINED MULTIPHASE CASTINGS

[75] Inventors: Kevin Francis Dolman, Marsfield; Craig Ian Walker, Narrabeen; Charles Philip Harris, East Hills; Andrew William Thomson, Normanhurst, all of Australia

[73] Assignee: Warman International Limited, Australia

[21] Appl. No.: 545,783

[22] PCT Filed: May 20, 1994

[86] PCT No.: PCT/AU94/00264

§ 371 Date: Jun. 18, 1996

§ 102(e) Date: Jun. 18, 1996

[87] PCT Pub. No.: WO94/27763

PCT Pub. Date: Dec. 8, 1994

[30] Foreign Application Priority Data

May 21, 1993 [AU] Australia ..... PL8948

[51] Int. Cl.[6] ..... B22D 27/00; B22D 19/14; C21D 5/00; C22F 1/18

[52] U.S. Cl. ..... 164/57.1; 164/97; 164/122; 164/55.1; 148/548; 148/668

[58] Field of Search ..... 164/97, 55.1, 122, 164/57.1, 46; 148/548, 668

[56] References Cited

FOREIGN PATENT DOCUMENTS

| | | | |
|---|---|---|---|
| 28865 | 12/1984 | Australia . | |
| 28865/84 | 12/1984 | Australia . | |
| 55-75855 | 6/1980 | Japan | 164/55.1 |
| 569887 | 8/1977 | U.S.S.R. | 164/55.1 |
| 405842 | 3/1934 | United Kingdom . | |
| 491341 | 9/1938 | United Kingdom . | |

OTHER PUBLICATIONS

Derwent Abstracts Accession No. 83–739050/33,Class P53., RO, A, 80–621; Inst. Politehn. Bucur.; 30 Nov. 1982.
Derwent Abstracts Accession No. 93–062000/08, Class P53, JP, A, 05–9632; Sekisui. Chem. Ind. Co. Ltd.; 19 Jan. 1993.
Patent Abstract of Japan, C100, p. 20, JPA, 57–5813, Sumitomo Kinzoku Kogyo K.K.; 12 Jan. 1982.
Derwent Abstract Accession No. 22633B/12, Class M22, JP, A, 54–18426; Kawasaki Steel K.K.; 10 Feb. 1979.
Derwent Abstract Accession No. 53468B/29, Class M22, JP, A, 54–71726; Kawasaki Steel K.K.; 8 Jun. 1979.
International Search Report; PCT/AU94/00264; 22 Aug. 1994; R. Howe.

*Primary Examiner*—Joseph J. Hail, III
*Assistant Examiner*—I. -H. Lin
*Attorney, Agent, or Firm*—Fish & Richardson P.C.

[57] ABSTRACT

The present invention relates to eutectic alloy systems, such as white irons, in which a primary phase grows out of the melt when the melt is cooled below the liquidus temperature and comprises pouring the molten metal alloy at a temperature at or above the liquidus in a stream into a casting mould to form a casting and introducing a particulate material into the stream of molten metal to extract heat from the molten metal alloy to undercool the molten metal alloy from the pour temperature into the primary phase solidification range between the liquidus and the solidus temperatures of the alloy and thereby initiate primary phase nucleation and restrict primary phase growth. The primary function of the particulate material is to act as a heat sink but the particulate material may at least partially dissolve in the melt and may act as a seeding agent for the primary phase. The invention is described with particular reference to high chromium hypereutectic white irons.

27 Claims, 8 Drawing Sheets

MICROSTRUCTURALLY REFINED MULTIPHASE CASTINGS

This is a continuation of International Application No. PCT/AU94/00264, with an international filing date of May 20, 1994, now abandoned.

TECHNICAL FIELD

The present invention relates to multiphase castings, and is particularly concerned with a casting method by which it is possible to refine a primary phase which forms out of a melt in a two phase region of a eutectic system. The invention is applicable to all metal systems whose solidification characteristics and final microstructures can be described by a eutectic phase diagram. Examples of such systems are aluminium/silicon, lead/tin, lead/antimony, copper/silver and iron alloys, especially white irons.

BACKGROUND OF THE INVENTION

In eutectic systems, solidification of alloys with hypereutectic and hypoeutectic compositions occurs over the temperature range defined by the liquidus and solidus temperatures for each alloy composition.

During solidification a primary phase forms by a nucleation and growth process. The size and distribution of the primary phase is determined, inter alia, by the cooling rate in the temperature interval between the liquidus and solidus. In general, the faster the cooling rate the finer the grain size and distribution of the primary solid phase.

There are several procedures described in the literature to increase the cooling rate through the solidification range:

(a) Use of minimum liquid metal pouring temperature i.e. just above the liquidus temperature.

(b) Using casting moulds with a higher chill factor than the usual silica sand based moulds, e.g. zircon sand, chromite sand and various metal moulds.

(c) Reducing casting metal thickness.

(d) Use of internal metal chills in the casting.

(e) Using alloys with chemical compositions close to the eutectic composition.

These procedures have certain limitations and are not applicable to every casting material or do not go far enough in the grain refinement process to substantially enhance desired material properties.

Some of these procedures, and some limitations, are discussed at length in Australian Patent Application AU-A-28865/84 in relation to white cast irons, both with hypoeutectic and hypereutectic compositions. AU-A-28865/84 sought to alleviate problems which had been identified in producing relatively thick section castings of high chromium hypereutectic white iron, by paying closer attention to the manufacturing variables in order to decrease the primary carbide size and to make the microstructure substantially constant throughout the casting section.

The wear resistant properties of white irons, including high chromium hypereutectic white irons, have been known for many years, and the latter alloys are used in the formation of wear resistant parts for lining pumps, pipes, nozzles, mixers and similar devices which are used to convey fluids containing abrasive particles, for example in mineral processing plants. The hypereutectic material consists of acicular $M_7C_3$ (wherein M=Cr,Fe,Mo,Mn) primary carbides in a matrix, and, in a paper by K. Dolman : Alloy Development : Shredder Hammer Tips, Proceeding of Australian Society of Sugar Cane Technology, April 1983, pp 81–87, it was outlined how the wear resistant properties of these materials increase directly with the volume fraction of primary carbide that is present in sugar mill hammer tip castings 25 mm thick. However a corresponding decrease in fracture toughness was also noted and in order to give the hammer tips sufficient toughness they were bonded to mild steel backing plates. The difficulty in producing thick section castings because of the tendency to crack was also noted.

AU-U-28865/84 aimed to overcome the disadvantages of low fracture toughness and cracking by providing, in a high chromium hypereutectic white iron casting having a volume fraction of primary carbides in excess of 20% substantially throughout the alloy, a primary carbide mean cross-sectional dimension not greater than 75 $\mu$m.

Apart from controlling the degree of superheat on pouring of the melt, it was proposed to achieve this aim by cooling the metal at a sufficient rate to restrict the growth of primary carbides. As an example of this procedure, a 25 mm thick hammer tip wear component cast in a zircon bearing shell mould was able to achieve a mean primary carbide diameter of 40 $\mu$m, with a super chilled zone about 0.5 mm thick formed at the interface of the mould and casting. However, in order to provide sufficient fracture toughness to avoid failure under extreme impact loading the casting had to be brazed to a mild steel backing plate, much as described in the aforementioned Dolman paper. Larger components, for example of 35 mm thickness, with sufficient fracture toughness were also cast with a mean carbide diameter of 40 $\mu$m, but only with the assistance of a permanent mild steel rod insert in the casting. It was specifically noted that identical castings without the insert had a mean carbide diameter typically about 100 $\mu$m and failed the fracture toughness tests. Thus, for alloy castings having a minimum thickness dimension of 30 mm, it was suggested that the insert preferably comprises at least about 10% by weight of the casting. For larger castings, for example having a minimum thickness dimension up to 70 mm, it was suggested that a chill mould be used as well as the insert.

AU-A-28865/84 also proposed the addition of carbide forming elements molybdenum, boron, titanium, tungsten, vanadium, tantalum and niobium to increase the volume fraction of primary carbides due to their strong carbide forming action. These elements are absorbed within the $M_7C_3$ carbides of the high chromium hypereutectic melt, to the limit of their solubility. Beyond the limit of their solubility, they form secondary or precipitated carbides within the matrix to provide some microhardening of the matrix and some increase in erosive wear resistance. It was also noted that where the carbide forming elements are present in the metallic form in an amount exceeding about 1.0 wt. %, they provided nucleating sites for the $M_7C_3$ primary carbides to an extent resulting in grain refinement of the $M_7C_3$ carbides.

There is no explanation in AU-A-28865/84 of when or how the metallic carbide forming elements were included in the melt, but it was suggested that the resultant carbides may at least in part come out of solution and that care was therefore required to ensure they were substantially uniformly dispersed in the melt at the time of pouring. It was also suggested in relation to the inclusion of metallic carbide forming elements to be desirable that the period for which the melt was held prior to pouring be kept to a minimum so as to avoid excessive growth of the carbide particles.

Instead of including the carbide forming elements in metallic form, they may according to AU-A-28865/84 be added as their carbides in fine particulate form. However, it was suggested that the fine particulate carbides may at least partially remain in suspension rather than go fully into solution in the melt and that this was particularly likely where the degree of superheating of the melt was limited. Again, therefore, care was required to ensure that the particulate carbides were substantially uniformly dispersed in the melt at the time of pouring the melt.

The addition of particulate material to the melt in order to increase the volume fraction of primary carbides as proposed in AU-A-28865/84 has not been practised in the art of hypereutectic white irons before the present invention.

U.S. Pat. No. 3,282,683 proposed the manufacture of an improved white iron having smaller, so-called undercooled or plate-type, carbides and increased toughness by the addition to the melt in the ladle, prior to pouring, of a carbide stabilizing or metastabilizing agent selected from a large number of elements. Similar undercooling by the addition of carbide metastabilizing agents to a nodular cast iron melt in the ladle is proposed in U.S. Pat. No. 2,821,473.

SUMMARY OF THE INVENTION

It is an object of the present invention to provide a method of refining the primary phase in cast eutectic alloy systems by the addition of particulate material to the melt in which control of the primary phase growth is improved compared to the prior art described above.

According to the present invention there is provided a method of casting a metal alloy of a eutectic alloy system comprising.

(a) forming a melt of the metal alloy;

(b) pouring the molten metal alloy at a temperature at or above the liquidus temperature in a stream into a casting mould to form a casting, and (c) introducing a particulate material into the stream of molten metal to extract heat from the molten metal alloy to undercool the molten metal alloy from the pour temperature into the primary phase solidification range between the liquidus and the solidus temperatures of the metal alloy.

Further according to the present invention there is provided an alloy casting when formed by the method described in the immediately preceding paragraph.

By substantially instantaneously extracting heat from the melt and undercooling the melt only as it is poured, the particulate material optimises the conditions for promoting the formation of a fine grain structure by maximising primary phase nucleation after the pour has started and thereby minimising primary phase growth, without the need for special moulds, chill plates and/or metal inserts. In addition, no separate stirring of the melt is required to ensure that the particulate material is thoroughly dispersed since the particulate material can be adequately dispersed as it is introduced to the melt during the pour or by movement of the melt in the mould as it is poured. In contrast, for example, to the proposal in AU-A-28865/84 of adding fine particulate carbides of carbide forming elements, the present invention reduces the time during which primary phase growth can occur, thereby better controlling the grain refinement, and optimises the uniform dispersal of the particulate material and therefore of primary phase nucleation without the need for separate stirring equipment for the melt in the ladle, thereby better controlling the uniform distribution of the primary phase. The particulate material may also act as a seed to provide primary phase nucleation and increased primary phase volumes, but the primary phase volume proportion is better able to be increased by virtue of the grain refinement allowing more primary phase constituent (e.g. carbon for carbide primary phase) to be included in the initial melt while avoiding the problems of the prior art, such as cracking.

A further advantage of the present invention is that it may allow a larger pouring window for the casting, which is highly beneficial in practice. Without the addition of the particulate material a melt must generally be poured within a narrow temperature window to ensure the desired physical properties are achieved, for example no more than 15° C. above liquidus, which is very difficult to achieve under foundry conditions. The increased rate of cooling provided during the pour by the addition of the particulate material accordance with the invention allows the pouring window to be increased, for example upto 30° C. or more above liquidus in the case of the previous 15° C. window, while maintaining or even reducing the final size of the primary phase.

The particulate material is preferably added to the melt uniformly through the pour, but the addition may be varied, interrupted or delayed if, for example, the same degree of grain refinement is not required throughout the casting The particulate material may be introduced to the final pour of the melt in any suitable manner, but preferably by injection through a nozzle. Injection may be performed in a carrier gas of, for example, compressed air or inert gas. Suitable injection equipment is the Wedron FF40 powder injection system or powder injection equipment manufactured by Foseco. The pour may be performed in the usual manner, for example by top or bottom casting from a ladle or from a tundish.

The amount of fine particulate material added to the melt may be dependent upon a variety of conditions, for example the degree of superheat, the level of undercooling required, the desired volume fraction of primary phase, the size of the casting and the degree of grain refinement. The preferred rate is in the range of 0.1 to 10% of the final casting weight, below which the effect may be minimal and above which the grain refinement may not be able to be controlled satisfactorily. A more preferred range is 0.1 to 5% of the final casting weight, and most preferably the addition is in a range from about 0.5% to about 1% of the final casting weight.

Advantageously, any type of element or compound that is not detrimental to the casting may be used as the particulate material, since the primary requirement is that the particulate material extracts heat from the melt and by that undercooling initiates multiple primary phase nuclei. Suitable types of material will vary with the melt. Preferably the particulate material is a metal or inorganic metal compound. Advantageously, the material is capable of at least partially melting and/or dissolving in the melt, but the material may be absorbed, at least in part, within the primary phase. One type of material that is suitable is a metal that is an integral part of the usual melt composition, for example particulate lead in a 30% tin/lead system (at a pour temperature of about 265° C.), particulate antimony in a 50% antimony/lead system (at a pour temperature of about 490° C.), particulate copper in a 30% silver/copper system (at a pour temperature of about 940° C.) and particulate iron, white iron (eg 27% Cr) or steel in an iron alloy such as a white iron. Other metal or metal compounds which may be suitable arm those which have a strong primary phase seeding action including, for high chromium hypereutectic white iron castings, those mentioned in AU-A-28865/84, namely one or more of molybdenum, boron, titanium, tungsten, vanadium, tantalum and niobium, whether as the metal or in carbide form. Still other materials which may be most suitable are those having a compatible crystallographic structure with the primary phase, for example, in the case of the $M_7C_3$ primary carbides of a high chromium hypereutectic white iron, high carbon ferrochrome and chromium carbide, since they can act as seeding sites for the primary phase in addition to providing rapid undercooling.

The particulate material, which is conveniently in powder form, preferably has a maximum particle size of no more than 200 μm, more preferably no more than 150 μm, since particles that arc too large may provide the required thermal mass effect but be ineffective in providing the desired grain refinement. Particles that are too small, for example with a maximum particle size of less than 5 to 10 μm, may be effective as a heat sink but may not be effective as seeding agents if they fully dissolve in the melt. More preferably the mean particle size of the particles is in the range 20 to 100 μm and the maximum particle size is no more than 75 μm. It may be advantageous for the maximum particle size to be no more than 50 μm.

Although the invention is applicable generally to multiphase castings, it is especially applicable to eutectic systems in which the primary phase can grow as a coarse, discrete phase. An example of such a system is high chromium hypereutectic white iron and, for convenience only, the invention will be further described with specific reference to this alloy.

The principal objective of the research that led to the present invention was to refine the microstructure of thick section hypereutectic white iron castings significantly more than was possible using conventional prior art casting technology. Hypereutectic white irons have offered the potential for significant wear improvement because of the high volumes of the very hard $M_7C_3$ primary carbides which could be formed. However, at these very high carbide levels the casting microstructure could not be produced at a fine enough size to give sufficient physical properties for a practical casting. In addition, the maximum carbon level in the prior art has been dictated by the maximum size of primary carbide which is subsequently formed and which determines the soundness of the final casting. By refining the microstructure a much higher carbon content and therefore volume of primary carbide can be utilised within the hypereutectic white iron, thereby enabling an increase not only in fracture toughness but also in wear resistance.

High chromium hypereutectic white iron comprises from about 3 to about 85 wt % carbon, from about 20 to about 45 wt % chromium and optional alloying additions of one or more of copper, manganese, molybdenum silicon and nickel as well as boron and other carbide forming elements, balance predominantly iron and incidental impurities including elements deed from the particulate material. The alloying additives in the molten metal composition preferably include, by weight up to about 15% manganese, up to about 10% molybdenum, up to about 10% nickel, up to about 3% silicon, up to about 5% copper and up to about 2% boron as well as up to about 10% derived from the particulate material. Up to about 1 wt % each of phosphorous and sulphur may also be included. Preferred compositions consist essentially of 4 to 5.5 wt % C, 28 to 37 wt % Cr, 1 to 4 wt % Mn, 0.1 to 1 wt % Si, 0.5 to 1.5 wt % Mo, less than 1 wt % Ni, less than 0.1 wt % P, less than 0.1 wt % S, balance Fe and incidental impurities.

It has been found that by the use of the present invention in casting high chromium hypereutectic white irons the $M_7C_3$ primary carbides can be substantially uniformly distributed throughout the casting with a mean cross-sectional dimension in a range of about 10 to 50 μm, preferably 15 to 45 μm, most preferably 20 to 30 μm. However, the mean cross-sectional dimension of the $M_7C_3$ primary carbides (hereinafter sometimes referred to as the "carbide size") is dependent among other things on the degree of superheat and the size of the casting, and acceptable castings may be produced with $M_7C_3$ primary carbide mean cross-sectional sizes above these ranges but with more freedom being permitted by the invention in the degree of superheat during casting and/or in the size of the casting. In particular, high chromium hypereutectic white iron castings with cross-sectional dimensions of 50 to 100 mm or more can readily be made by the invention with acceptable physical properties without the use of internal chills or the like.

In general, the optimum pouring temperature at which the particulate material is added to a melt is dependent on the liquidus temperature, casting section size, and the amount of powder added, and the preferred pouring temperature (°C.) for a high chromium hypereutectic white iron melt may be defined by the formula:

| liquidus (°C.) + A + 15B | |
|---|---|
| where A = | 15° C. for casting section thickness less than 50 mm |
| = | 10° C. for casting section thickness from 50 to 100 mm |
| = | 5° C. for casting section thickness greater than 100 mm. |
| .B = | amount of particulate material in weight %. |

The same formula may be applicable to other melts, but in relation to the high chromium hypereutectic white iron melt the formula is aimed primarily at achieving a carbide size of 25 μm.

The $M_7C_3$ primary carbides in the high chromium hypereutectic white iron will normally exist in a matrix of eutectic carbide and martensite with retained austenite. The $M_7C_3$ primary carbides will generally be acicular and with much the same aspect ratio as in the prior art white irons. Because of the relatively small $M_7C_3$ primary carbides achievable by the method of the invention, it is now practical to subject the high chromium hypereutectic white iron castings to hardening by heat treatment without cracking the castings. Secondary carbides may develop as a result of heat treatment or from the melt. The heat treatment may be an age hardening procedure such as by soaking at from 750° to 1050° C. for, for example 2 to 5 hours at 900° to 1000° C., followed by air or furnace cooling. Alternatively, the casting may be subjected to a heat treatment such as cryogenic chilling, for example down to minus 200° C.

The minimum $M_7C_3$ primary carbide content in the high chromium hypereutectic white iron is preferably of the order of 20 volume %, but a far higher $M_7C_3$ primary carbide content, for example up to 50 volume % or higher is possible. Such levels of $M_7C_3$ primary carbide content would lead to very brittle castings and possibly cracking without the grain refinement also achievable by the present invention. The eutectic phase is generally accepted as containing of the order of 30% eutectic $M_7C_3$ carbides.

BRIEF DESCRIPTION OF THE DRAWINGS

Various embodiments of method in accordance with the invention will now be described by way of example only with reference to the accompanying drawings, in which.

EXAMPLES

The following examples are given to further illustrate the invention in relation to various compositions of high chromium hypereutectic white iron. They have been selected for convenience only and are not intended to limit the invention in any way. In all of the examples in accordance with the invention powder material was injected into a stream of a high chromium hypereutectic white iron melt, as it was poured into the mould, with compressed air using a Wedron FF40 powder injection system running at a feed rate of 9 kg/min. This is sometime referred to as "mould inoculation" in the Examples.

Example 1

A chromium carbide powder having a particle size range of minus 150 μm was injected into the liquid metal at a delivery rate of 10 kg of powder per tonne of liquid metal (1%) in two different ways: a) by addition to the ladle at about 100° C. superheat (ladle inoculation) shortly before pouring into the casting mould; b) by introduction into the molten stream during filling of the mould (mould inoculation). The castings were of an impeller having a maximum thickness of 150 mm. The section analyzed had a thickness of 40 mm.

Figure 1:
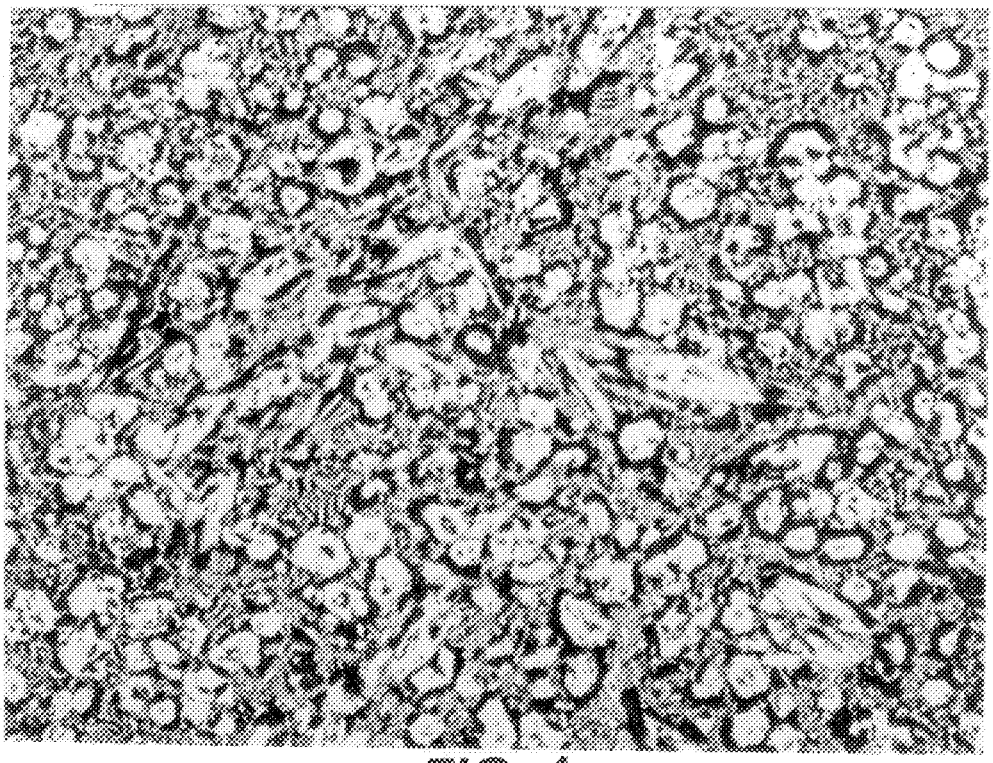
FIG. 1 is an optical photomicrograph at 100x magnification of the ladle inoculated high chromium hypereutectic white iron casting of Example 1.
Figure 2:
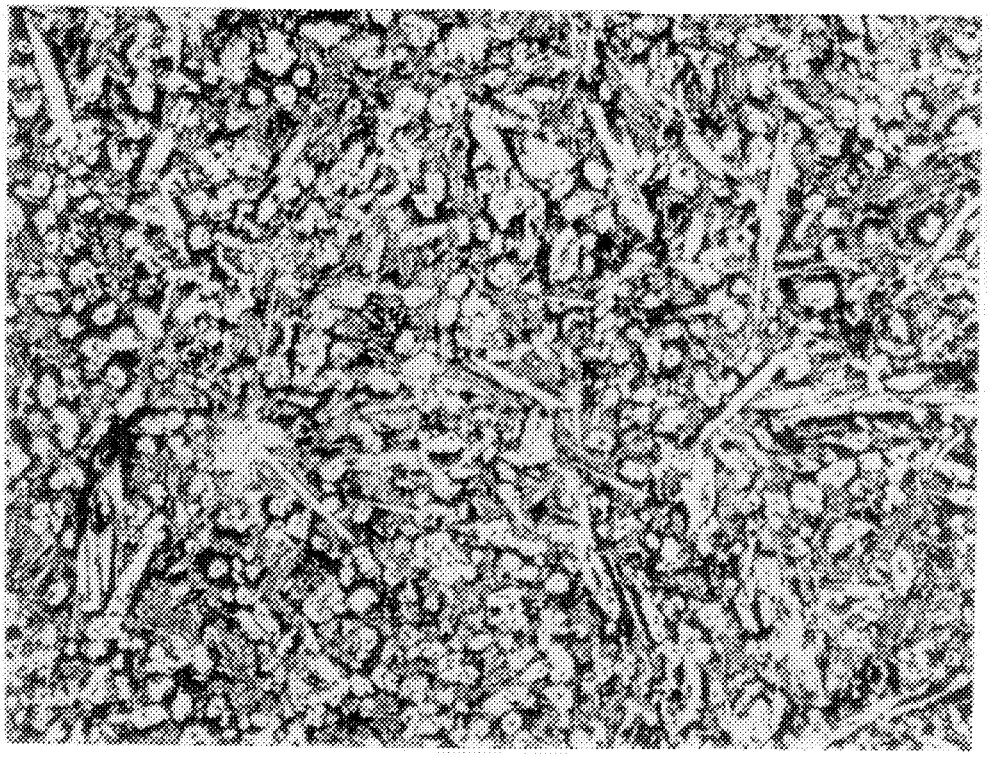
FIG. 2 is an optical photomicrograph at 100x magnification of the mould inoculated high chromium hypereutectic white iron casting of Example 1, having the same melt composition as the casting of FIG. 1.

The compositions, conditions and results of the as cast material are set out in Table 1. The reduction in primary carbide cross-sectional dimension is dearly evident from the photomicrographs (mag: 100x) of FIGS. 1 (ladle inoculation) and 2 (mould inoculation).

TABLE 1

| | Ladle Inoculation | Mould Inoculation |
|---|---|---|
| Composition wt. % | | |
| Cr | 29.97 | 3008 |
| C | 4.31 | 4.039 |
| Mn | 2.04 | 2.03 |
| Si | 0.55 | 0.56 |
| Mo | 0.99 | 0.98 |
| Ni | 0.30 | 0.30 |
| Fe | bal | bal |
| Pour Temp °C. | 1464 | 1369 |
| Liquidus °C. | 1364 | 1364 |
| Primary Carbide volume % | 25 | 25 |
| Mean Primary Carbide size μm | 40 | 20–25 |
| Hardness: Vickers HV 0.05 g | 699 | 694 |

Figure 3:
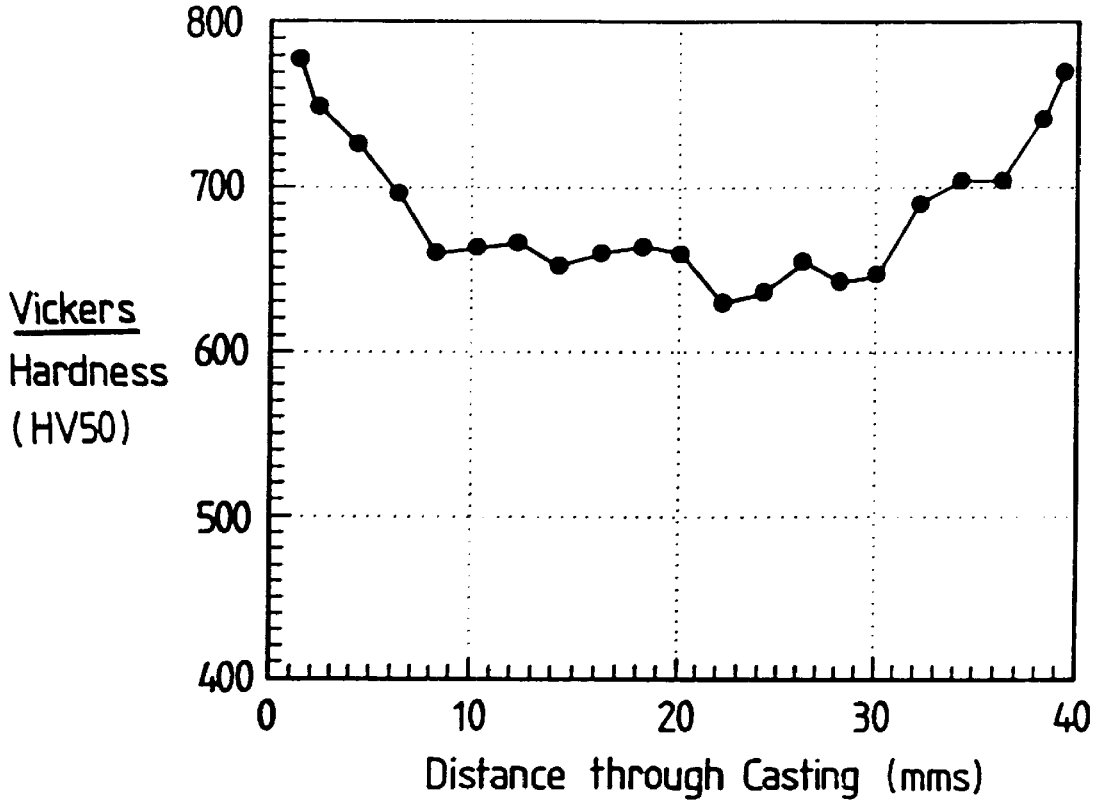
FIG. 3 is a graph showing a Vicker's Hardness traverse through the full thickness of the mould inoculated casting of Example 1.

The fractured surface of the mould inoculated impeller exhibited an appearance typical of a fine grain structure throughout the 40 mm thickness of the casting and FIG. 3 illustrates the results of a Vickers Hardness traverse through the full thickness. A surface hardness of about 780 HV dropped to about 650 HV at a depth of about 8–10 mm below the surface.

The ladle inoculated casting showed a hypereutectic microstructure consisting of primary $M_7C_3$ carbides having a mean cross-sectional dimension of 40 μm with a matrix of eutectic carbides with martensite and retained austenite. There was no evidence of undissolved chromium carbide in the microstructure.

The mould inoculated casting showed a fine hypereutectic microstructure consisting of primary $M_7C_3$ carbides having a mean cross-sectional dimension of less than 25 μm (and therefore about half of the ladle inoculated sample) with very fine eutectic carbides in an austenite/martensite matrix. Some relatively coarse carbide particles were in evidence, typical of partially dissolved chromium carbide. The martensite was present as a consistent layer around all primary and eutectic carbides and appears to have initiated at the carbide/ferrous matrix interface with growth occurring into the austenite phase. Its presence would tend to enhance wear resistance and lower the toughness of the material.

The presence of undissolved large chromium carbide particles in the casting indicated that the particle size of the powder, nominally less than 150 μm, was not optimum. The larger particles in the powder are inefficient in seeding the primary carbides in the microstructure. The powder also contained a substantial amount of very fine particles that are nominally less than 10 μm. These particles would fully dissolve in the melt and would be effective in rapidly reducing the temperature of the liquid but would not be effective as seeding agents for carbide formation. A maximum particle size of about 75 μm is considered appropriate.

In conclusion, the introduction of 1 wt % chromium carbide powder to the stream of melt was sufficient to rapidly undercool the liquid metal from a superheat of about 5° C. to a temperature just below the liquidus and within the two phase (liquid+carbide) region due to a thermal mass effect and thereby restrict the growth of the primary $M_7C_3$ carbides. In addition, the chromium carbide powder, having the same crystal structure and a higher melting point than the primary $M_7C_3$ carbides, acted as a compatible and effective seeding agent for nucleating multiple primary carbides in the casting.

Example 2

This example considered a high chromium hypereutectic white iron casting containing 5.5 wt % carbon and mould inoculated with chromium carbide powder at a rate of 1% of the final casting weight.

An upper carbon limit of 4.5 wt % had previously been imposed on the standard composition of high chromium hypereutectic white iron because primary $M_7C_3$ carbide coarsening was considered excessive above that limit. However, higher carbon levels lead to higher carbide contents in the microstructure and hence greater wear resistance.

Figure 4:
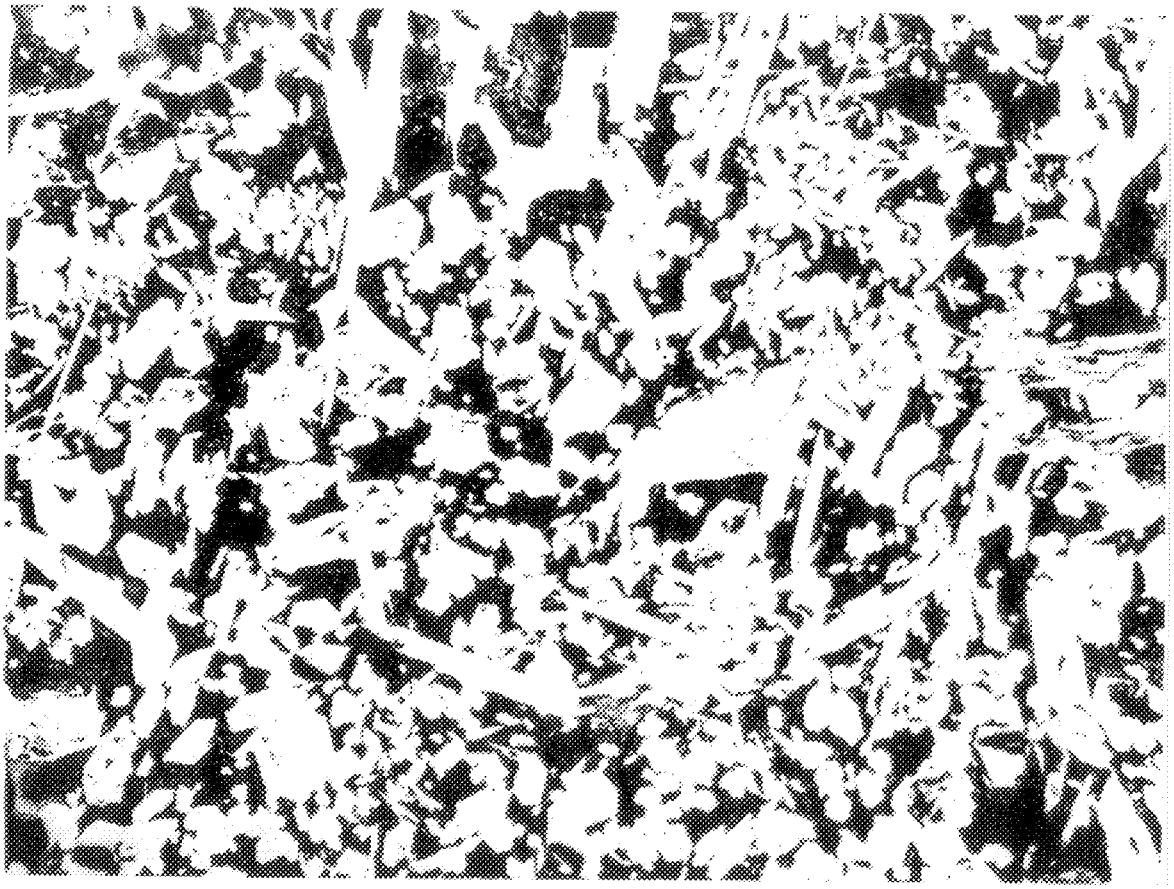
FIG. 4 is an optical photomicrograph at 100x magnification of the high carbon mould inoculated casting of Example 2.

The composition, conditions and results of the as cast material are set out in Table 2. The photomicrograph of FIG. 4 (mag: 100x) illustrates the hypereutectic microstructure exhibiting a high volume fraction of primary $M_7C_3$ carbides with some irregular CrC carbides being evident. Higher magnifications illustrate the ferrous matrix showing some martensite and secondary carbide precipitants.

A visual examination of the casting revealed there was some evidence of carbide needles with an estimated maximum length of 3 mm. This is somewhat finer than the carbide size observed in standard (4.5 wt % C) high chromium hypereutectic white iron castings. Gas holes due to trapped air were observed near the top surface of the casting. The surface gas holes may be eliminated with the use of a higher pouring temperature of 1425°–1430° C. or a reduction in the carbon content, for example to 5.0 wt %. Some coarse undissolved chromium carbide particles were noted in the microstructure, but it is considered these can be eliminated with a smaller inoculation powder size, for example minus 75 μm.

In conclusion, mould inoculation with 1 wt % chromium carbide powder of a high chromium hypereutectic white iron melt which has a carbon content of 5.5 wt % is effective in maintaining a primary $M_7C_3$ carbide mean cross-sectional dimension below about 50 μm. The addition of the inoculation powder to the melt compensated for the adverse effects of the higher carbon content.

TABLE 2

| Composition wt. % | |
|---|---|
| Cr | 30.9 |
| C | 5.55 |
| Mn | 1.99 |
| Si | 0.61 |
| Mo | 1.54 |
| Ni | 0.53 |
| Fe | bal |
| Inoculant Particle Size μm | −150 |
| Inoculation/Pour Temp °C. | 1420 |
| Liquidus °C. | 1407 |
| Primary Carbide volume % | 62 |
| Mean Primary Carbide size μm | 50 |
| Harndess: Vickers HV 0.05 g | 730 |

Example 3

This example describes the effect of increasing the degree of superheat to 30° C. on the mould inoculation with 1 wt % chromium carbide powder of a standard high chromium hypereutectic white iron. It also examines the role of the original CrC inoculating particles in the final microstructure of the casting.

The composition, conditions and results of the as cast 30° C. superheat material are set out in Table 3.

TABLE 3

| Composition wt. % | |
|---|---|
| Cr | 30.6 |
| C | 4.31 |
| Mn | 2.01 |
| Si | 0.70 |
| Mo | 1.5 |
| Ni | 0.56 |
| Fe | bal |
| Inoculant Particle Size μm | −150 |
| Pour Temp °C. | 1400 |
| Liquidus °C. | 1370 |
| Primary Carbide Vol % | 25 |
| Mean Primary Carbide Size μm | 50 |
| Hardness: Vickers HV 0.05 g | 681 |

The mould inoculation of a standard high chromium hypereutectic white iron melt with chromium carbide at a rate of 1% of the final casting weight and at a superheat of 30° C. produced a primary $M_7C_3$ carbide size of 50 μm. However, some macroshrinkage and microshrinkage were observed and this could be attributed to the pouring temperature being too high or to the amount of inoculation powder added being insufficient to undercool the melt below the liquidus temperature during inoculation. Some partially dissolved CrC carbide particles were observed and some secondary carbide precipitation was evident in the ferrous matrix.

Figure 5:
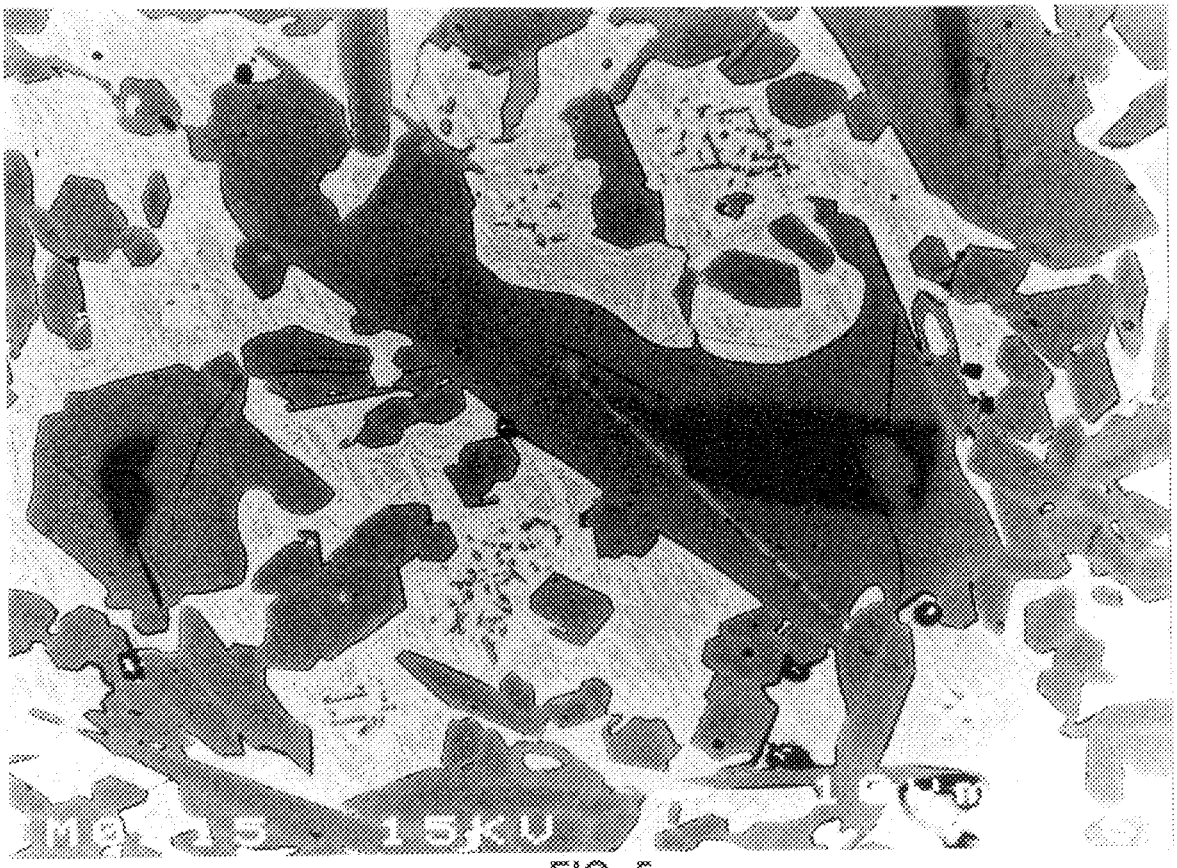
FIG. 5 is a scanning electron microscope back scattered image of the casting of Example 3 which has been mould inoculated at a superheat of 30° C.

A secondary electron image of the microstructure of the 30° C. superheat mould inoculated casting is shown in FIG. 5. Dark central cores in the three relatively coarse carbides were shown by microanalysis to contain chromium only and were consistent with the stoichemistry of the $Cr_7C_3$ carbides. Lighter outer rims of these castings contain iron and chromium consistent with the stoichemistry of $(Fe, Cr)_7 C_3$ carbides. This shows that the partially dissolved $Cr_7C_3$ powder particles have acted as seeds for the growth $(Fe, Cr)_7 C_3$ carbides in the microstructure. This is evidence that the addition of CrC powder to the high chromium hypereutectic white iron melt has a two fold effect on the final microstructure. 1) rapid undercooling of the molten metal to a temperature below the liquidus line; and 2) the partially dissolved $Cr_7C_3$ particles acting as effective seeds for nucleation and growth of the primary $M_7C_3$ carbides. This occurs because the crystal structures (unit cell type, size and lattice parameters) for the carbides $Cr_7C_3$ and $(Fe, Cr)_7 C_3$ are compatible, and in fact almost identical.

Analysis of the ferrous matrix also shows that its carbide/matrix boundary regions are lighter than portions between the boundary regions. This indicates that the lighter boundary regions are chromium depleted. During formation of the chromium rich primary carbides, chromium is removed from the immediate surrounding regions causing coring in the final ferrous matrix. The observed presence of martensite in these boundary regions in Examples 1 and 2 is attributed to the presence of a chromium depleted zone in the ferrous matrix.

Example 4

This example compares the casting of Example 3 with two castings from identical melts but with one casting identically mould inoculated except at a superheat of 15° C. and with the other casting not inoculated at all. This was used to show that the thermal mass cooling of the molten metal by the inoculation may be a method of expanding the relatively small range of pour temperatures which have been applicable in the past for the manufacture of high chromium hypereutectic white iron castings with acceptable carbide sizes.

The mould inoculation of a high chromium hypereutectic white iron melt with 1 wt % chromium carbide at a superheat of 30° C. produced a primary carbide size of 50 μm. This is similar to the same melt cast at a superheat of 15° C. with no inoculation. However, as compared to the shrinkage described in Example 3, the casting at a superheat of 15° C. with no inoculation was sound.

The same mould inoculation as in Example 3 but at a superheat of 15° C. yielded a casting with a mean primary $M_7C_3$ carbide cross-sectional dimension of 25 μm, but gas holes near the surface which suggests the pouring and inoculation temperature was slightly too low.

It can be shown that the addition of each 1.0 wt % powder to the melt by mould inoculation is equivalent to a 15° C. temperature drop in the molten melt. From this it can be shown that the optimum pouring temperature for the effective mould inoculation of high chromium hypereutectic white iron castings where the required mean primary $M_7C_3$ carbide size is 25 μm is dependent on a) liquidus temperature, b) casting section size and c) amount of inoculant added, according to the following empirical formula:

| | | |
|---|---|---|
| Pouring Temperature (°C.) | = | Liquidus Temperature (°C.) + A + 15B |
| where A | = | 15° C. for a casting section thickness less than 50 mm |
| | = | 10° C. for casting section thickness from 50 to 100 mm |
| | = | 5° C. for casting section thickness greater than 100 mm. |
| and B | = | % inoculant powder of the final casting weight. |

As a rough rule for white iron castings, it may be said that a casting thickness of 50 mm is equivalent to a final casting weight of 100 kg and a casting thickness of 100 mm is equivalent to a final casting weight of 500 kg.

Example 5

This example compares mould inoculation using 1) high carbon ferrochrome (Fe-Cr) powder (−75 μm), 2) CrC powder (1–150 μm) and 3) iron powder (−200 μm) of high chromium hypereutectic white iron melts at injection rates ranging from 1 to about 2.5% of the final casting weight and at superheats varying from 10° to 40° C., to determine the effect of the variables on microstructure, hardness and wear resistance compared with the standard high chromium hypereutectic white iron. All trials were carried out on an impeller weighing 450 kg.

In this and subsequent examples using high carbon ferrochrome of nominally minus 75 μm particle size, a sizing analysis shows that the approximately 90% of the powder has a particle size between 10 and 60 μm. Chemical analysis shows the following wt % composition: 8.42% C, 69.1% Cr, 0.71 Mn, 1.31% Si, 0.06% Mo and 0.27% Ni.

Table 4 sets out the chemical composition of the castings examined. Sample pieces 70×50×40 mm were cast with the impellers for each melt and were tested by 1) visual examination, 2) metallography, 3) hardness testing, 4) wear testing, and 5) chemical analysis. The chemical analysis results set out in Table 4 show that all samples were within specification. The chemical analysis also showed the presence of sulphur and phosphorous, but each at less than 0.05 wt %, and of boron, but at less than 0.002 wt %.

TABLE 4

| | Composition wt. % - balance Fe | | | | | |
|---|---|---|---|---|---|---|
| Sample | Cr | C | Mn | Si | Mo | Ni |
| A851 | 31.17 | 4.33 | 2.00 | 0.55 | 1.05 | 0.30 |
| A852 | 30.78 | 4.40 | 2.01 | 0.49 | 1.07 | 0.30 |
| A853 | 30.61 | 4.38 | 2.05 | 0.59 | 1.05 | 0.30 |
| A854 | 30.55 | 4.42 | 2.07 | 0.62 | 1.07 | 0.30 |
| A855 | 30.82 | 4.28 | 2.02 | 0.55 | 1.05 | 0.30 |
| A856 | 30.66 | 4.36 | 2.04 | 0.56 | 1.07 | 0.30 |
| A857 | 35.28 | 4.92 | 2.09 | 0.73 | 1.02 | 0.32 |
| A858 | 35.31 | 4.91 | 2.05 | 0.64 | 1.01 | 0.32 |
| A859 | 34.85 | 4.80 | 2.02 | 0.53 | 1.01 | 0.18 |
| A860 | 30.23 | 4.36 | 2.18 | 0.57 | 0.99 | 0.19 |
| A861 | 30.23 | 4.36 | 2.18 | 0.57 | 0.99 | 0.19 |
| A862 | 30.25 | 4.40 | 2.15 | 0.58 | 0.99 | 0.19 |
| A863 | 30.25 | 4.40 | 2.15 | 0.58 | 0.99 | 0.19 |
| A864 | 29.97 | 4.46 | 2.19 | 0.54 | 0.99 | 0.19 |
| A865 | 29.97 | 4.46 | 2.19 | 0.54 | 0.99 | 0.19 |
| A866 | 30.39 | 4.35 | 2.15 | 0.54 | 0.98 | 0.19 |

Visual Examination

Examination of the fracture faces of the samples revealed a very fine fracture face (mean primary $M_7C_3$ carbide cross-sectional dimension of 50 μm or less) on all mould inoculated samples except A859, a relatively high carbon melt inoculated at a relatively high superheat. The two non-inoculated castings, A851 and A866 showed the normal coarse fracture face.

Examination of the surface finish of the castings showed all castings were satisfactory and there was no evidence of cold folds or shrinkage in the impeller castings.

Inspection after machining the mould inoculated castings reported no evidence of subsurface gas holes.

Metallography

All samples were examined for general microstructure. This revealed, in all samples, the standard high chromium hypereutectic white iron microstructure of primary $M_7C_3$ carbides with a eutectic carbide and ferrous matrix, as described already. In the CrC inoculated castings there were approximately 0.5 vol % of undissolved CrC particles present throughout the casting. A structure similar in appearance to pearlite colonies was found with varying percentages in each sample. The primary $M_7C_3$ carbide volume in the mould inoculated samples were estimated as ranging from 20 to 35%. Total primary carbide volume may be up to 50%.

All samples were also examined for carbide size and the results are set out in Table 5.

Figure 6:
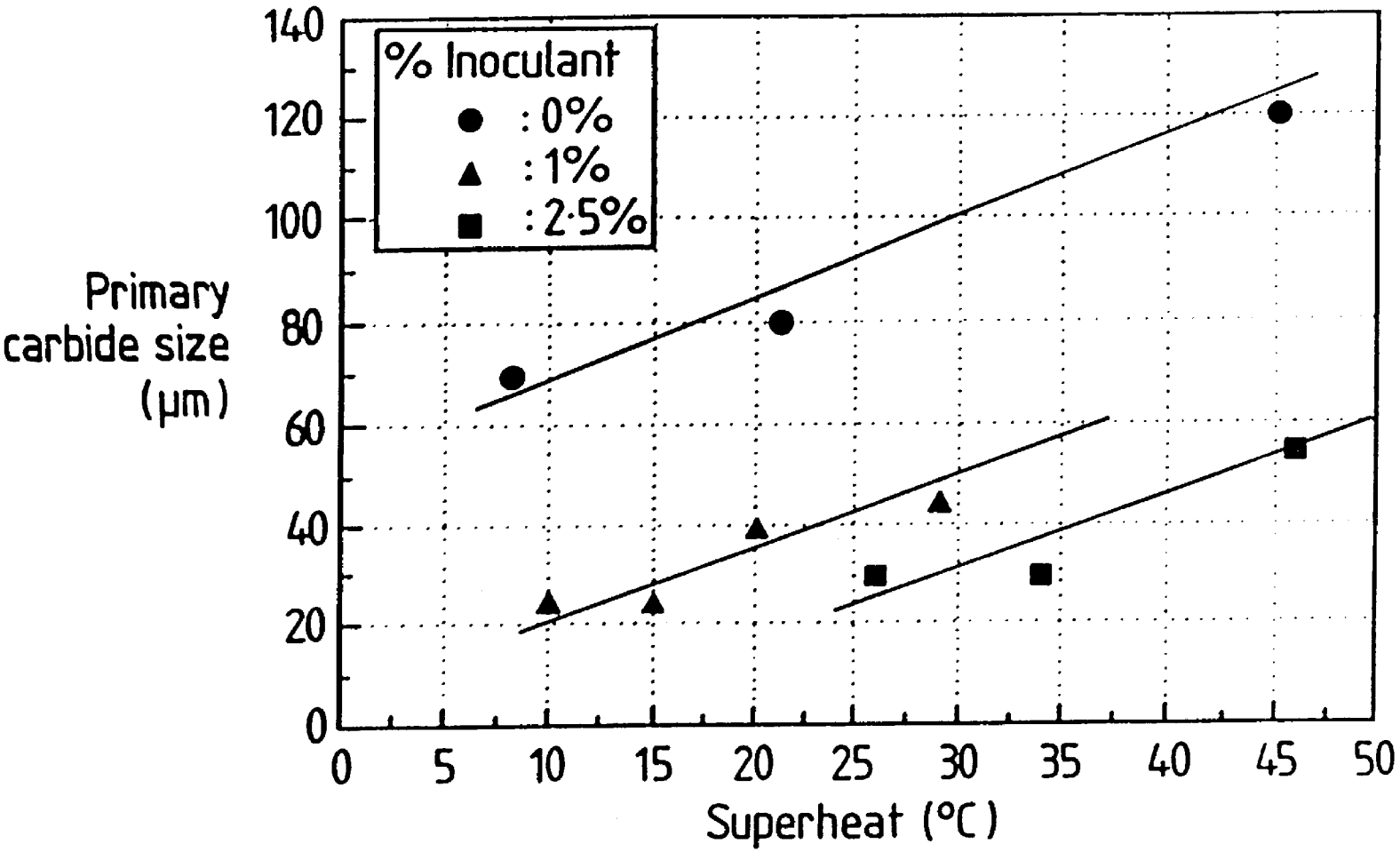
FIG. 6 is a graph showing the relationship between the degree of superheat, the amount of mould inoculation and the primary carbide size as described in Example 5.

The influence on primary carbide size of superheat and amount of inoculant powder is graphically illustrated for Fe-Cr mould inoculated samples in FIG. 6 from which it may be seen that: a) with no inoculation, the primary carbide size varies from about 50 μm with no superheat to about 100 μm at 30° C. superheat which agrees well with production castings; b) with about 1% inoculant the primary carbide size is reduced by about 40 μm at all superheats, a 1° C. increase in superheat causes 1 μm increase in primary carbide size and 50° C. superheat can still yield a sound casting but with a carbide size of about 70 μm; and c) with about 2.5% inoculant very fine primary carbide sizes can be achieved, e.g. about 10 μm at 20° C. superheat, although cold folds and gas porosity may present problems at pouring temperatures of less than about 15° C. superheat, and the influence of the inoculant powder decreases with increasing contents.

Hardness Results

Vicker's hardness tests were carried out on all samples at 1 mm and 10 mm below the cast surface using a 50 kg load. The results are summarised, along with other results, in Table 5.

Figure 7:
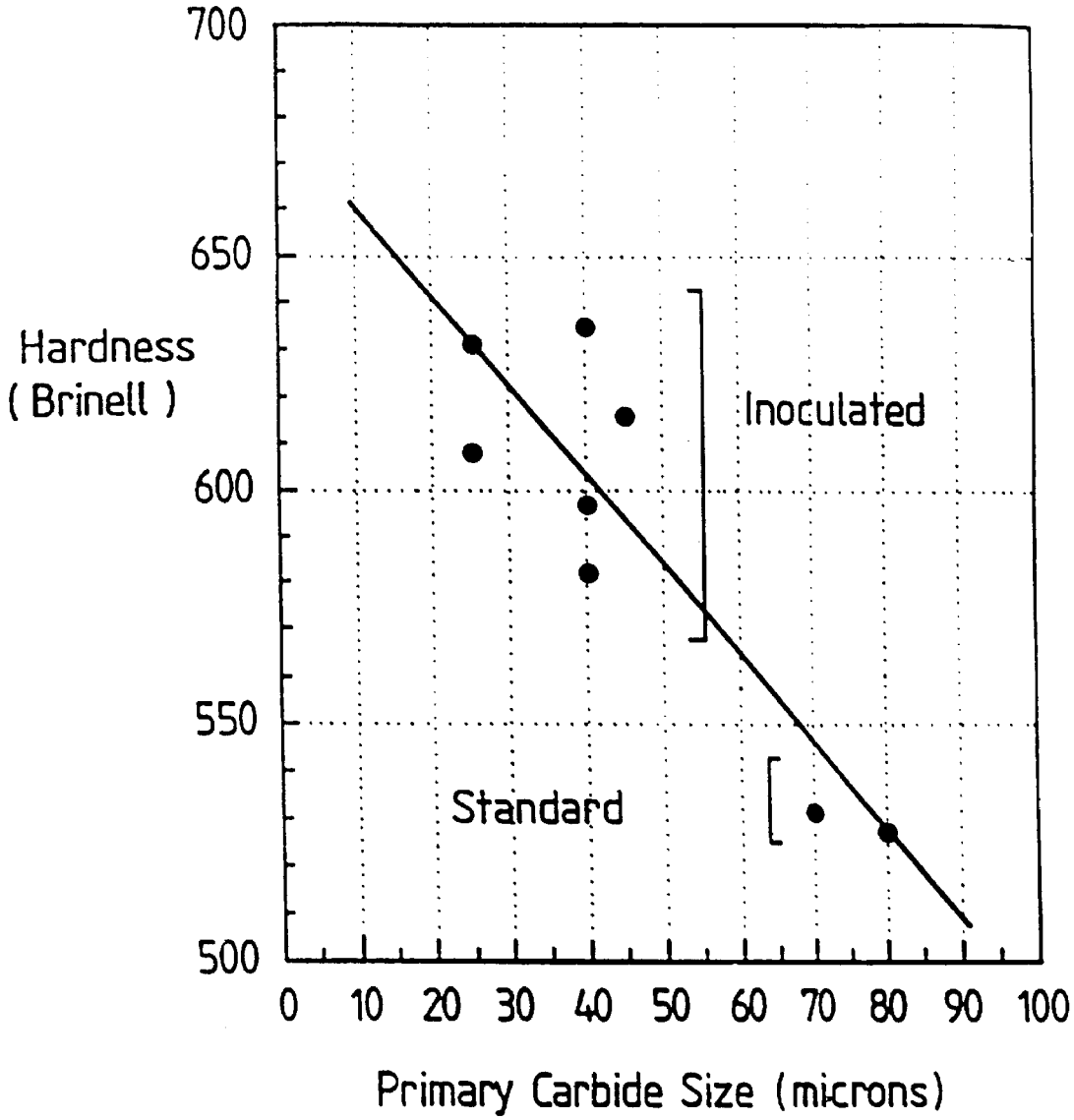
FIG. 7 is a graph showing the relationship between primary carbide and casting hardness as described in Example 5.

From Table 5 is may be seen that there was an average improvement of 67 Brinell in the mould inoculated samples A852–A856 and A860 to A865 having carbon contents in the range 4.34 to 4.46 wt % at 10 mm below the surface compared with the standard high chromium hypereutectic white iron samples A851 and A866, and a similar increase in hardness at 1 mm depth. Samples A857 to A859 showed an average increase of 125 Brinell at the 10 mm depth due to their higher carbon and chromium content. FIG. 7 illustrates how the decreasing carbide size increases the gross hardness.

TABLE 5

| Sample no. | Liqu °C. | Pour temp °C. | Sup °C. | Powder Type | Powder Size mm | Powder Actual % | Carbide Size μm | Hardness HV50 1 mm[1] | Hardness HV50 10 mm[1] | Hardness HB 1 mm[1] | Hardness HB 10 mm[1] | Vol. % Pearlite |
|---|---|---|---|---|---|---|---|---|---|---|---|---|
| A851 | 1365 | 1373 | 8 | — | — | 0 | 70 | 632 | 566 | 594 | 531 | 17% |
| A852 | " | 1375 | 10 | Fe—Cr | −75 | 1 | 25 | 680 | 672 | 638 | 631 | App. 10% |
| A853 | " | 1380 | 15 | Fe—Cr | −75 | 1.1 | 25 | 645 | 647 | 606 | 608 | |
| A854 | " | 1394 | 29 | Fe—Cr | −75 | 1 | 45 | 648 | 655 | 609 | 616 | |
| A855 | " | 1385 | 20 | Fe—Cr | −75 | 1.1 | 40 | 639 | 635 | 601 | 597 | |
| A856 | " | 1381 | 16 | CrC | −150 | 1# | 40 | 658 | 619 | 618 | 582 | |
| A857 | 1403 | 1428 | 25 | Fe—Cr | −75 | 1.1 | 50 | 713 | 689 | 665 | 646 | |
| A858 | " | 1421 | 8 | CrC | −150 | 1.1 | 45 | 726 | 683 | 673 | 641 | |
| A859 | 1403 | 1429 | 26 | Fe—Cr | −75 | 1.1 | 80 | 777 | 703 | 708 | 657 | |
| A860 | 1364 | 1410 | 46 | Fe—Cr | −75 | 2.5 | 55 | 676 | 635 | 635 | 597 | |
| A861 | " | 1398 | 34 | Fe—Cr | −75 | 2.7 | 30 | 629 | 567 | 591 | 532 | |
| A862 | " | 1390 | 26 | Fe—Cr | −75 | 2.2 | 30 | 673 | 653 | 632 | 614 | |
| A863 | " | 1382 | 18 | Fe—Cr | −75 | 2.3 | 40 | 709 | 677 | 662 | 635 | |
| A864 | " | 1390 | 26 | Fe | −200 | 1.2 | 45 | 625 | 601 | 587 | 564 | 27% |
| A865 | " | 1382 | 18 | Fe | −200 | 1.1 | 40 | 631 | 621 | 593 | 584 | |
| A866 | " | 1385 | 21 | — | — | 0 | 80 | 573 | 562 | 538 | 527 | |

Notes
[1]Depth below cast surface
[2]# Allowing for losses.

Wear Test

Eductor wear tests were carried on ten of the sixteen samples as shown in Table 6 with the tests being performed at a 30° angle and a velocity of 20 m/s. The testing was carried out using 10 kg of medium Silica River Sand (SRS) W300 d85 (485 μm). Wear rate 1 was measured at the surface of the sample while wear rate 2 was measured in from the cast surface.

As noted previously, samples A851 and A866 are of standard high chromium hypereutectic white iron with no inoculant while samples A858 and A859 are from high carbon and high chromium melts.

Figure 8:
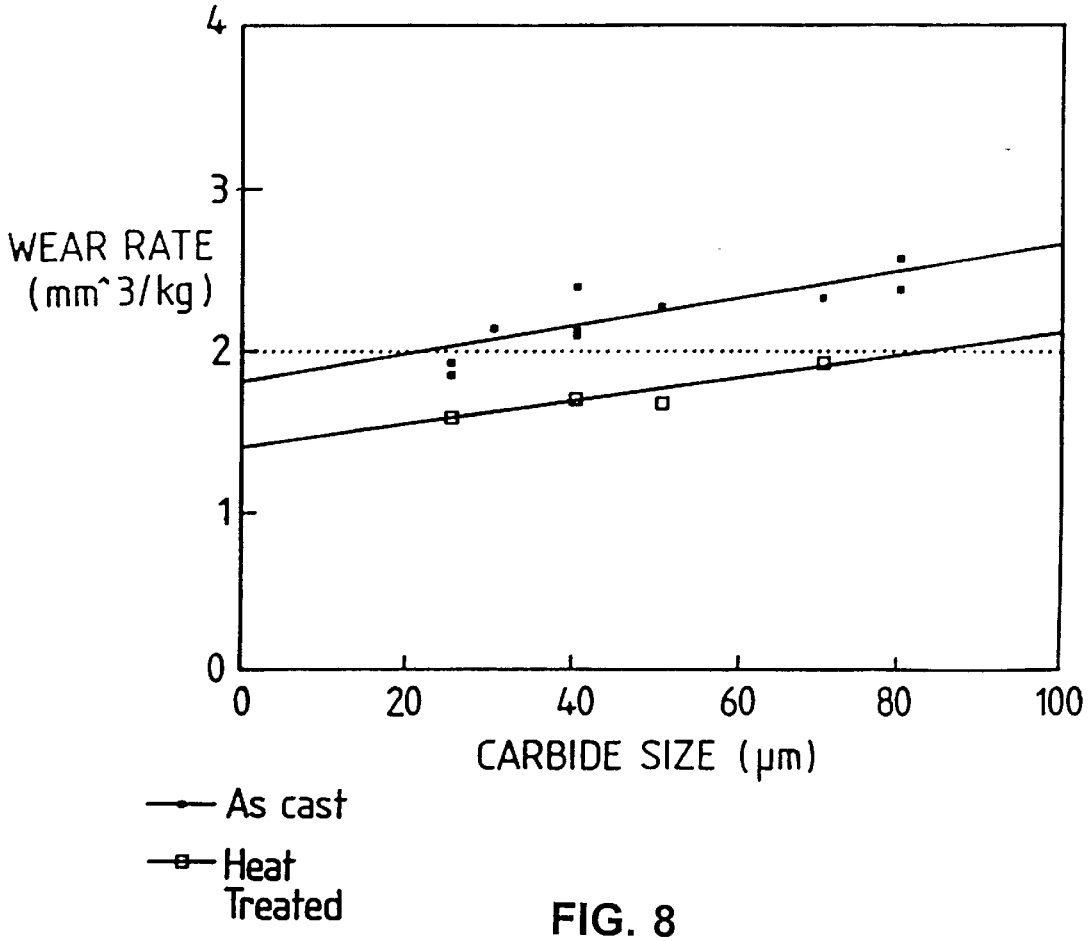
FIG. 8 is a graph showing the relationship between wear rate and primary carbide size, both as cast as described in Example 5 and after heat treatment as described in Example 6.

FIG. 8 graphically illustrates the trend to improved wear resistance with finer primary carbides in the SRS W300 wear medium.

In conclusion, it has been shown that all three of powder proved effective, although there are possible disadvantages with Fe powder due to the high percentage of pearlite formed. However, these disadvantages may be eliminated with a small change in the melt composition or by the use of heat treatment.

TABLE 6

| Sample | Inoculant Powder and Superheat °C. | Wear Rate (mm ^3/kg) 1 | Wear Rate (mm ^3/kg) 2 | Average Wear Rate (mm ^3/kg) | Carbide Size μm |
|---|---|---|---|---|---|
| A851 | none 8 | 2.10 | 2.56 | 2.33 | 70 |
| A852 | 1%FeCr 10 | 1.81 | 1.89 | 1.85 | 25 |
| A853 | 1%FeCr 15 | 1.85 | 1.99 | 1.92 | 25 |
| A855 | 1%FeCr 20 | 2.56 | 2.22 | 2.39 | 40 |
| A858* | 1%CrC 16 | 2.59 | 1.94 | 2.27 | 50 |
| A859* | 1%FeCr 10 | 2.62 | 2.52 | 2.57 | 80 |
| A861 | 2%FeCr 34 | 2.14 | 2.12 | 2.13 | 30 |
| A863 | 2%FeCr 18 | 2.18 | 2.00 | 2.09 | 40 |
| A865 | 1%Fe 18 | 2.35 | 1.91 | 2.13 | 40 |
| A866 | none 21 | 2.63 | 2.13 | 2.38 | 80 |

Example 6

FIG. 8 also illustrates the further improvement in wear rate following a heat treatment of four of the samples of Example 5, as shown in Table 7. Eductor wear test conditions were the same as in Example 5. The heat treatment was carried out by heating the castings to 950° C. and holding for 4.5 hours, followed by air cooling.

TABLE 7

| Sample | Inoculant Powder and Superheat °C. | Wear Rate (mm ^3/kg) 1 | Wear Rate (mm ^3/kg) 2 | Average Wear Rate (mm ^3/kg) | Carbide Size μm |
|---|---|---|---|---|---|
| A851 | none 8 | 1.78 | 2.07 | 1.93 | 70 |
| A852 | 1%FeCr 10 | 1.55 | 1.61 | 1.58 | 25 |
| A858* | 1%CrC 16 | 1.86 | 1.46 | 1.66 | 50 |
| A865 | 1%Fe 18 | 1.81 | 1.58 | 1.70 | 40 |

As discussed in Example 7, the wear rate increased following heat treatment due to an increase in the hardness of the ferrous matrix. No cracks were noted in the heat treated samples.

Example 7

This example considered the effect of heat treating three high chromium hypereutectic white iron castings which have been mould inoculated with about 1% final casting weight of minus 75 μm Fe-Cr powder and poured at superheats of from 25° to 27° C. The after-casting heat treatment comprised heating the castings to 950° C. and holding for 45 hours, followed by air cooling.

The castings were of various pump parts and all had the same wt % composition of Cr 30.7, C 4.5, Mn 2, Si 0.57, Mo 0.94, Ni 0.57, B O, S 0.03, P 0.04 Fe balance. The melt was the same for all castings and had a liquidus of 1355° C. The castings were tested 1) by visual examination, 2) by metallograph and 3) for hardness, all both before and after heat treating.

From the visual examination, all fracture faces showed an appearance typical of a fine grained structure of a high chromium hypereutectic white iron, with no cracks before or after heat treatment.

The microstructures were typical of a high chromium hypereutectic white iron with fine primary carbide sizes of 20–25 μm cross-sectional dimension uniformly spread throughout the matrix. The results of the analyses and details of the matrices are set out in Tables 8 and 9, respectively.

TABLE 8

| Sample | Condition | Pouring temp °C. | Supheat °C. | Carbide Size μm | Carbide Vol %[3] | Gross Hardness[1] Vickers HV50 | Gross Hardness[1] Brinell Conversion | Microhardness[1] HB Primary Carbide | Microhardness[1] HB Matrix ferrous phase | Gross hardness increase HB |
|---|---|---|---|---|---|---|---|---|---|---|
| 1 | As cast | 1380 | 25 | 25 | 25 | 606[2] | 569[2] | 1527 | 536 | |
| 1 | Heat Treated | " | " | 20 | 25 | 721 | 671 | 1566 | 653 | 102 |
| 2 | As cast | 1382 | 27 | 25 | 25 | 653 | 614 | 1564 | 442 | |
| 2 | Heat Treated | " | " | 20 | 25 | 735 | 681 | 1663 | 617 | 67 |
| 3 | As cast | 1380 | 25 | 25 | 25 | 628 | 590 | 1426 | 405 | |
| 3 | Heat Treated | " | " | 25 | 25 | 798 | 720 | 1537 | 637 | 130 |

Notes
[1]Hardness 10 mm below surface.
[2]Hardness 5 mm below surface.
[3]Estimated

TABLE 9

| Sample | Condition | Matrix |
|---|---|---|
| 1 | As cast | eutectic carbides, martensite and retained austenite with some fine 2° carbide precipitates |
| 1 | Heat Treated | eutectic carbides, martensite and fine 2° carbide precipitates |
| 2 | As cast | eutectic carbides, martensite and retained austenite |
| 2 | Heat Treated | eutectic carbides, martensite and fine 2° C. carbide precipitates |
| 3 | As cast | eutectic carbides, martensite and retained austenite |
| 3 | Heat Treated | eutectic carbides, martensite and fine 2° C. carbide precipitates |

Figure 9:
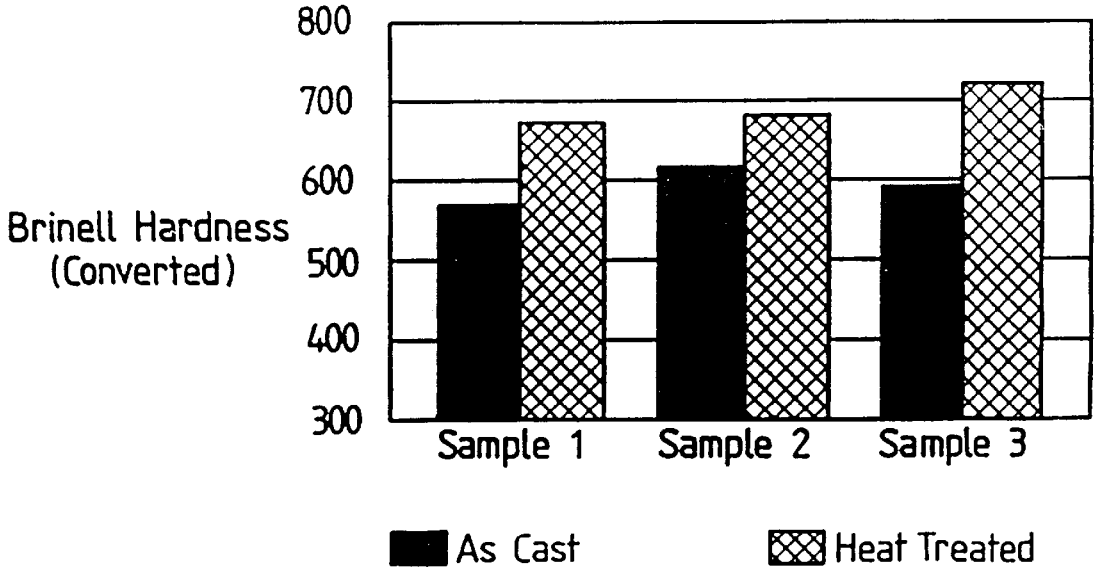
FIG. 9 is a graph comparing hardness before and after heat treatment as described in Example 7.

The gross hardness results showed that the heat treated samples had an increase in hardness of from 67 to 102 Brinell, and this is depicted graphically in FIG. 9. Analyzing the microhardness of the castings established that the increase in gross hardness was due to the increase in hardness of the ferrous matrix. Wear tests in previous examples have shown that higher hardness achieved by heat treatment increases the wear resistance.

It will be appreciated from the preceding description that a substantial advantage of the casting method of the present invention as applied to high chromium hypereutectic white iron is that a relatively small $M_7C_3$ primary carbide cross-sectional size can be readily achieved in an inexpensive, quick and uncomplicated manner using existing casting equipment. This is achieved by introducing a particulate material to the molten metal composition at the last possible moment, actually during the pour of the melt into the casting mould, to achieve a degree of undercooling which in turn promotes the formation of the fine grain structure by maximising the number of primary carbide nuclei and thereby minimising their growth. The addition of the cooling powder in this way allows a greater pouring window for the casting which is highly beneficial in foundry practice. It also allows substantially larger castings, for example upto 3000 kg, to be poured than has been possible in the past without cracking. Past practice has only achieved 100 μm mean cross-sectional primary carbides in 100 mm cross-sectional castings without internal chills. Similar sized and larger tough castings can be readily made by the present invention with a primary carbide mean cross-section of 50 μm and less, preferably in the range 20–30 μm. Advantageously these microstructure can be achieved with carbon contents of 5.5 wt % and higher leading to increased carbide volumes and wear resistance. The relatively small primary carbide size increases the wear resistance of the castings and the fracture toughness, as well as allowing heat treatments to be performed to further increase the hardness and wear resistance. The skilled person in the art will appreciate that many modifications and variations are possible within the broad invention, and all such modifications and variations should be considered as within the scope of the present invention. In particular it will be appreciated that the invention is applicable to other eutectic alloy systems in which a primary phase grows out of the melt.

We claim:

1. A method of casting a metal alloy which comprises a primary phase dispersed in a eutectic phase, the method comprising:

(a) forming a melt of the metal alloy;

(b) pouring the molten metal alloy at a temperature at least above the liquidus temperature in a stream into a casting mould to form a casting; and (c) introducing a particulate material into the stream of molten metal to extract heat from the molten metal alloy to undercool the molten metal alloy from the pour temperature into the primary phase solidification range between the liquidus and the solidus temperatures of the metal alloy to provide, in a the casting mould, a casting including a primary phase dispersed in a eutectic phase.

2. A casting method according to claim 1 wherein the particulate material is introduced uniformly to the melt through the pour.

3. A casting method according to claim 1 wherein the particulate material is injected through a nozzle into the stream of molten metal.

4. A casting method according to claim 3 wherein the particulate material is injected into the stream of molten material in a carrier gas comprising compressed air.

5. A casting method according to claim 1 wherein the particulate material is introduced to the melt at a rate in the range of 0.1 to 10% of the casting weight.

6. A casting method according to claim 5 wherein the amount of particulate material is no more than 5% of the final casting weight.

7. A casting method according to claim 6 wherein the amount of particulate material is in the range 0.5 to 1% of the final casting weight.

8. A casting method according to claim 1 wherein the maximum particle size of the particulate material is 200 $\mu$m.

9. A casting method according to claim 1 wherein the minimum particle size of the particulate material is 5 $\mu$m.

10. A casting method according to claim 1 wherein the mean particle size of the particulate material is in the range 20 to 100 $\mu$m.

11. A casting method according to claim 1 wherein the particulate material is a powder.

12. A casting method according to claim 1 wherein the particulate material is selected from the group consisting of metals, inorganic metal compounds and alloys.

13. A casting method according to claim 1 wherein the particulate material at least partially dissolves in the melt.

14. A casting method according to claim 1 wherein the particulate material has a higher melting point than the melt.

15. A casting method according to claim 1 wherein particles of the particulate material are at least partly absorbed within the primary phase.

16. A casting method according to claim 1 wherein the particulate material has a compatible crystallographic structure with the primary phase.

17. A casting method according to claim 1 wherein the metal alloy is a high chromium hypereutectic white iron and the primary phase consists of $M_7C_3$ carbides.

18. A casting method according to claim 17 wherein the alloy has a composition by wt % about 3 to 8.5% C, 20 to 45% Cr, up to 15% Mn, up to 3% Si, up to 10% Mo, up to 10% Ni, up to 5% Cu, up to 2% B, up to 1% P, up to 1% S, balance Fe and incidental impurities.

19. A casting method according to claim 18 wherein the alloy has a composition by wt % consisting of 4 to 5.5% C, 28 to 37% Cr, 1 to 4% Mn, 0.1 to 1% Si, 0.5 to 1.5% Mo, <1% Ni, <0.1% P, <0.1% S, balance Fe and incidental impurities.

20. A casting method according to claim 17 wherein the primary $M_7C_3$ carbide volume is at least 20% and the primary $M_7C_3$ carbides are uniformly spread throughout the casting.

21. A casting method according to claim 17 wherein the mean primary $M_7C_3$ cross-sectional dimension is in the range 10 to 50 $\mu$m.

22. A casting method according to claim 21 wherein the dimension is in the range 20 to 30 $\mu$m.

23. A casting method according to claim 17 wherein the particulate material is selected from the group consisting of high carbon ferrochrome, chromium, carbide and iron.

24. A casting method according to claim 17 wherein the pour temperature (°C.) is approximately equal to

| Liquidus (°C.) + A + 15B | |
|---|---|
| where A = | 15° C. for casting section thickness less than 50 mm |
| = | 10° C. for casting section thickness from 50 to 100 mm |
| = | 5° C. for casting section thickness greater than 100 mm. |
| B = | amount of particulate material in weight %. |

25. A casting method according to claim 17 wherein following casting the casting is subjected to a heat treatment which increases the hardness of the matrix.

26. A casting method according to claim 25 wherein the heat treatment comprises soaking the casting at from 750° to 1050° C. for 2 to 5 hours followed by air or furnace cooling.

27. A casting method according to claim 1 wherein the maximum particle size of the particulate material is 75 $\mu$m.

* * * * *